US006146291A

United States Patent [19]

Nydigger

[11] Patent Number: 6,146,291

[45] **Date of Patent: *Nov. 14, 2000**

[54] BASEBALL BAT HAVING A TUNABLE SHAFT

[76] Inventor: James D. Nydigger, 1240 Alandale Ave. SW., Albany, Oreg. 97321

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,616

[22] Filed: Aug. 16, 1997

[51] Int. Cl.[7] ..... A63B 59/06

[52] U.S. Cl. ..... 473/566

[58] Field of Search ..... 473/323, 564, 473/567, 566

[56] References Cited

U.S. PATENT DOCUMENTS

| | | | |
|---|---|---|---|
| Re. 31,811 | 1/1985 | Foreman . | |
| 1,670,530 | 5/1928 | Cowdery | 473/323 |
| 1,670,531 | 5/1928 | Cowdery | 473/323 |
| 1,778,181 | 10/1930 | Brinkman . | |
| 1,962,804 | 6/1934 | Cassady . | |
| 1,979,430 | 11/1934 | Wright . | |
| 2,023,131 | 12/1935 | Gibson . | |
| 2,095,563 | 10/1937 | Cowdery . | |
| 2,240,456 | 4/1941 | Darner . | |
| 3,479,030 | 11/1969 | Merola . | |
| 3,618,945 | 11/1971 | Kuchar . | |
| 3,841,130 | 10/1974 | Scott, Jr. et al. . | |
| 3,854,316 | 12/1974 | Wilson . | |
| 3,969,155 | 7/1976 | McKeighen . | |
| 3,972,528 | 8/1976 | McCracken . | |
| 4,056,267 | 11/1977 | Krieger . | |
| 4,169,595 | 10/1979 | Kaugers . | |
| 4,241,919 | 12/1980 | Foreman . | |
| 4,330,126 | 5/1982 | Ramble et al. . | |
| 4,498,321 | 2/1985 | Yoshida . | |
| 4,546,976 | 10/1985 | Jones . | |
| 4,622,841 | 11/1986 | Yoshida . | |
| 4,746,117 | 5/1988 | Noble et al. . | |
| 4,834,370 | 5/1989 | Noble et al. . | |
| 4,940,247 | 7/1990 | Magadini | 473/566 |
| 4,961,576 | 10/1990 | Meredith . | |
| 5,074,555 | 12/1991 | Meredith . | |
| 5,150,897 | 9/1992 | Wortman | 473/567 |
| 5,163,679 | 11/1992 | Lo . | |
| 5,415,398 | 5/1995 | Eggiman . | |
| 5,451,047 | 9/1995 | Liu | 473/564 |
| 5,551,689 | 9/1996 | Svoma et al. . | |
| 5,711,728 | 1/1998 | Marcelo | 473/564 |
| 5,766,104 | 6/1998 | Albarelli, Jr. | 473/567 |
| 5,833,561 | 11/1998 | Kennedy et al. | 473/567 |

FOREIGN PATENT DOCUMENTS

| | | | |
|---|---|---|---|
| 25376 | 9/1952 | Finland . | |
| 89-0289 | 9/1990 | Japan . | |
| 404189375 | 7/1992 | Japan | 473/FOR 17 |

*Primary Examiner*—Mark S. Graham

[57] ABSTRACT

A baseball bat having a tunable shaft and method for forming same. A hollow shaft is disposed between the barrel and the handle of a baseball bat, the hollow shaft having a plurality of hollow tunable sub-portions and transition portions disposed between the tunable sub-portions. The sub-portions form cylinders and the transition portions are frustoconical shapes providing for transition between the cylinders. The tunable sub portions are formed by rolling and thereafter swaging metal stock.

3 Claims, 4 Drawing Sheets

BASEBALL BAT HAVING A TUNABLE SHAFT

TECHNICAL AREA

This invention relates to baseball bats generally and to methods for forming metal baseball bats in particular. More particularly, this invention relates to a metal baseball bat having a tunable shaft providing for optimized adjustment of the dynamic response of the bat.

BACKGROUND OF THE INVENTION

In ball-hitting sports generally, players want to impart to the ball as much momentum as possible, either so that it may pass by an opponent quickly, before the opponent has a chance to react, or so that the ball travels a long distance toward a goal. More particularly, in sports such as baseball and golf, one important aim is to hit the ball as far as possible, and a player's capability to do this is an important source of the player's satisfaction.

One way to enable a player to hit a ball farther or harder is to improve on the hitting characteristics of the hitting implement. In some sports, such as golf and tennis, such improvements are accepted and, to an ever increasing extent, demanded by players. Baseball on the other hand, much more than other sports, is infused with tradition and nostalgia. Fans and players alike are generally accustomed, therefore, to the characteristics of the classic solid, ash-wood bat and have not tended to think in terms of altering those characteristics. An important reason for, as well as cause of, this acceptance is the major leagues' insistence in its rules on the use of such all-wood bats.

However, hollow metal bats have been employed by the minor leagues, especially in practice, and by people just having fun. But the prior art in metal bats has, consonant with the above observation, focused on attempts to emulate the performance of the wood bat rather than to improve thereupon. Particularly, these emulating efforts have been directed to the material of which the bat is constructed, which includes metal, plastics and composites (see *New Scientist*, supra, at 27; Jones, U.S. Pat. No. 4,546,976), the weight of the bat (see Bahill and Karnavas, "The Ideal Baseball Bat", *New Scientist*, Apr. 6, 1991, at 26), the distribution of the weight of the bat (e.g, Noble, U.S. Pat. No. 4,834,370), the surface elasticity of the bat (so-called "trampoline effect;" see "Wood-Composite Baseball Bats Take the Field," supra) and the pressure inside a hollow bat (e.g, Foreman, U.S. Pat. No. Re. 31,811).

Other sports, such as golf and tennis, are not so bound by tradition and greater creativity has generally been in evidence in the design and re-design of the implements employed for hitting the ball. However, improving the performance in any of these implements has been a difficult technical challenge, beginning with the difficulty in analyzing the dynamics of the implements having various proposed structures simply to understand what potential structural features to employ, or reject. This can be especially appreciated when one realizes that the performance improvements sought can be relatively small and still provide a player using the improved implement with a noticeable and highly desirable edge over his or her opponents, or a noticeable and highly satisfying personal performance improvement.

Researchers have tried to analyze the mechanics of the baseball-bat interaction and the dynamics of the baseball bat, and have noted great difficulties. In "The Dynamical Theory of the Baseball Bat", *American J. of Physics*, 60 (2), February 1992, at 172, L. L. Van Zandt proposes a mathematical model of a wooden baseball bat which demonstrates so-called normal modes of bending of the bat. "The irregular shape [of the baseball bat] precludes any possibility of accurate analytical solution for a realistic model . . . [, accordingly,] the tool for study of the bat is the computer." Id. at 173. The author concludes that the bending modes of the bat contribute significantly to the range of the flight of the ball and states that "it is possible to imagine tuning the bat to produce optimum hitting performance" by adjusting the normal mode bending frequencies, but fails to suggest any way of doing so. Further, "the normal modes can be strongly influenced by relatively minor changes in the cross-sectional contours of the bat." Id. at 180. Regarding the trampoline effect, it is noted that "there is no convincing scientific proof of what's happening in the ball-bat collision. " "Wood-Composite Baseball Bats Take the Field," supra at 45. Indeed, the dynamics of baseball is regarded by many as a "black art." "Wood-Composite Baseball Bats Take the Field," supra at 44.

Probably equally as a result of the great weight of tradition and the technical difficulties in characterizing and therefore improving on the dynamics of the baseball bat-baseball interaction, baseball bat performance has not been significantly advanced over that of the classic ash-wood bat. Therefore, the multitude of players who desire as all players do to "hit the ball out of the park" but who do not have the athleticism of a major league baseball player continue to want for more in the black art of baseball bat design.

Accordingly, there is a need for a baseball bat having a tunable shaft that provides for tuning the baseball bat for achieving peak hitting performance superior to baseball bats heretofore known in the art.

SUMMARY OF THE INVENTION

The baseball bat having a tunable shaft of the present invention solves the aforementioned problems and meets the aforementioned need by employing a hollow shaft disposed between the barrel and the handle of a baseball bat, the hollow shaft having a plurality of hollow tunable sub-portions and transition portions disposed between the tunable sub-portions. Such a bat has been observed to provide superior ball-hitting performance to both metal and wood bats having classically tapered shafts.

The hollow shaft and the handle are preferably formed monolithically, from a sheet of metal, preferably titanium, which has been rolled into a tubular form and joined at opposite edges. Preferably, the barrel is deep drawn to form a cup shape having a circumferential edge, wherein the circumferential edge of the barrel is joined to a circumferential edge of a distal most one of the tunable sub-portions or transition portions.

Therefore, it is a principal object of the present invention to provide a baseball bat and method for fabrication thereof having a tunable shaft, for improved ball-hitting performance.

It is another object of the present invention to provide such a baseball bat having tunable sub-portions for facilitating tuning of ball-hitting performance.

It is yet another object of the present invention to provide a method for forming a baseball bat having a tunable shaft.

It is still another object of the present invention to provide a method for forming a baseball bat having tunable sub-portions.

The foregoing and other objects, features and advantages of the invention will be more readily understood upon consideration of the following detailed description of the invention taken in conjunction with the accompanying drawings.

DETAILED DESCRIPTION OF A PREFERRED EMBODIMENT

Figure 1:
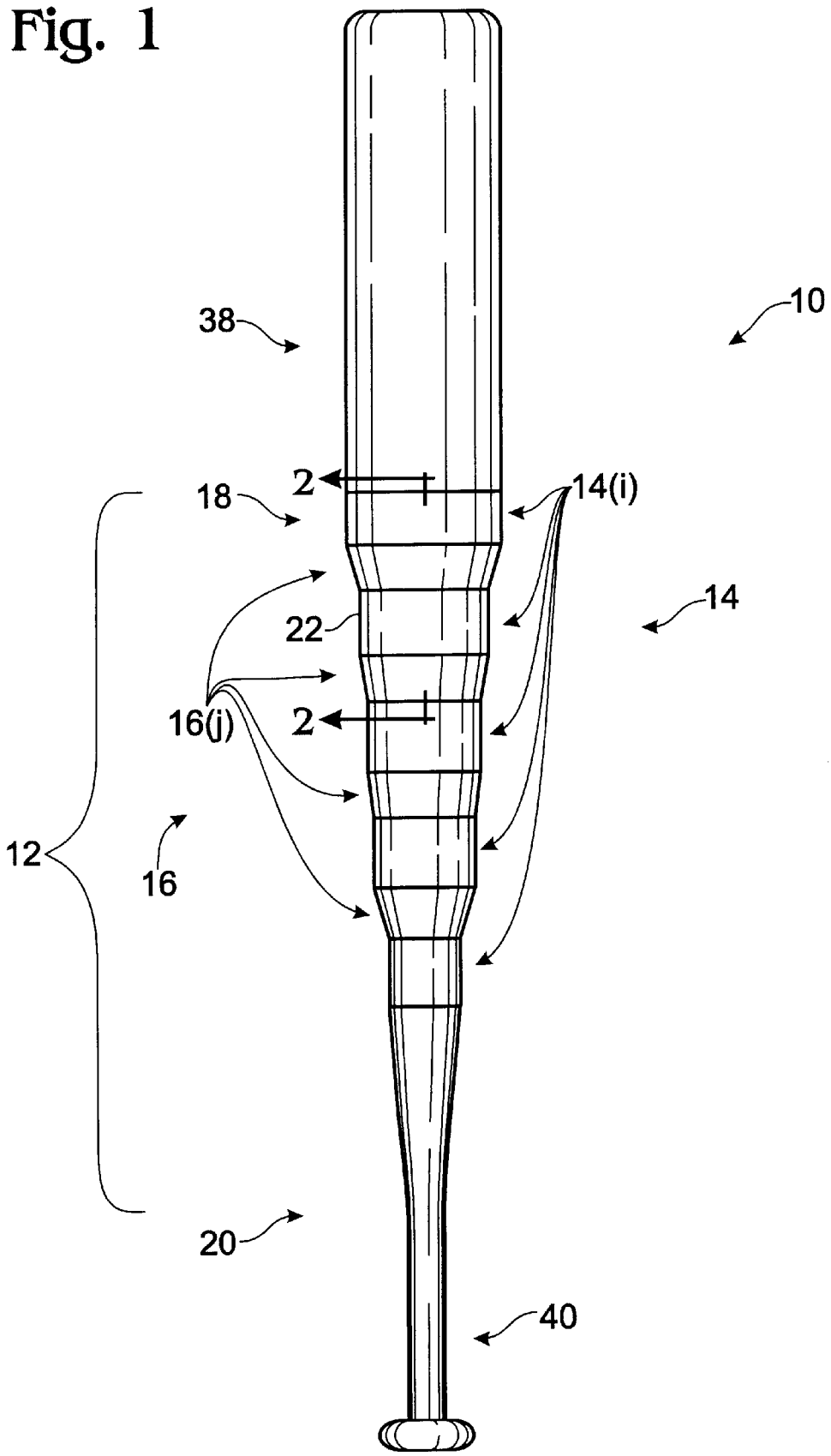
FIG. 1 is an elevation of a baseball bat having a tunable shaft according to the present invention.

Referring to FIG. 1, a preferred embodiment of a baseball bat 10 having a tunable shaft according to the present invention provides an elongate shaft 12 which includes a barrel portion 18 adapted for hitting a baseball, at one end of the shaft, and a handle portion 20, at the other end of the shaft. For reference, the shaft has an elongate axis "L".

The shaft 12 includes a plurality of tunable sub-portions 14(*i*), where "i" is an integer varying from 1 to N (referred to collectively as 14). The tunable sub-portions 14(*i*) form a sequence which extends substantially with the axis "L" so that, in progressing along the axis, each one of the sub-portions is followed by one other of the sub-portions until a last sub-portion is reached.

In order to fully realize the advantages of the present invention, it is believed that the number "N" of tunable sub-portions 14 should be a limited number, so that the tunable sub-portions and transition portions taken together do not become so numerous as to effectively approximate a classically tapered shape. However, it is not known how large the number "N" may be, and it is believed that N may be any reasonable number without departing from the principles of the invention.

The tunable sub-portions 14 are hollow as defined by a cylindrical wall 22. The sub-portions are preferably formed of a metal having an inherently high stiffness, i.e., Young's Modulus, in relation to weight or density, such as aluminum or, most preferably, titanium.

Figure 2:
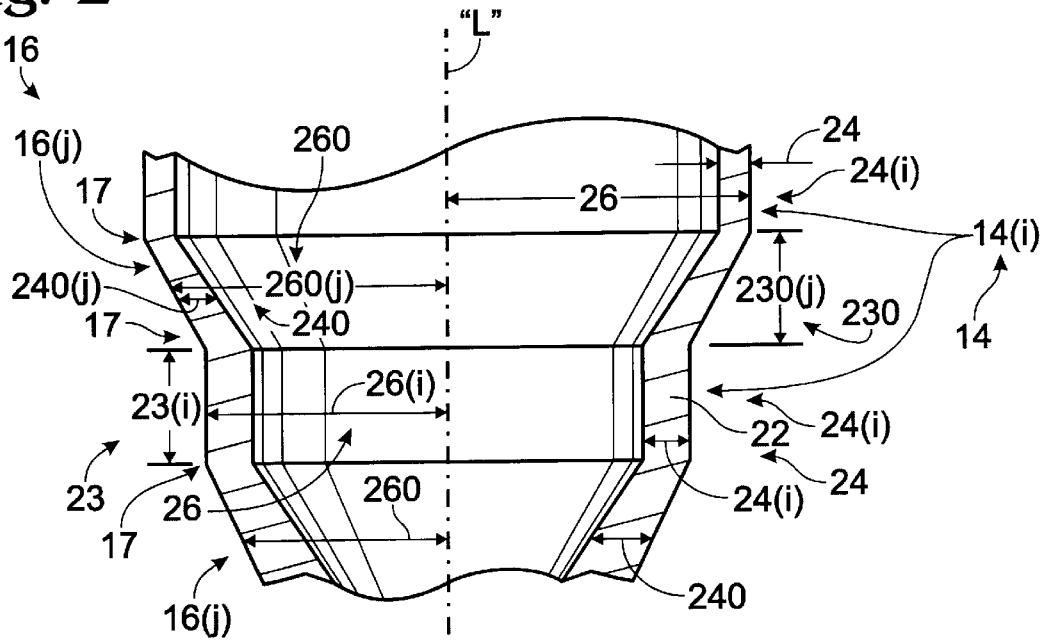
FIG. 2 is a cross-section of a portion of the elevation of FIG. 1, taken along a line 2—2 thereof, showing a tunable section of the tunable shaft of FIG. 1, according to the present invention.

Referring also to FIG. 2, the tunable sub-portions 14(*i*) are substantially cylindrical with associated cylindrical diameters 26(*i*) (referred to collectively as 26) which are substantially constant over associated lengths 23(*i*) (referred to collectively as 23) of the sub-portions which are aligned with the axis "L". The cylindrical diameter 26 of a sub-portion 14 generally vary from the cylindrical diameters of adjacent of the sub-portions by discrete amounts corresponding to the proximity of the sub-portion to the barrel 18. Preferably, the cylindrical diameters 26 vary in substantially linear proportion to the proximity of the sub-portion to the barrel; however, the cylindrical diameters may vary in other relationships without departing from the principles of the invention.

Moreover, because the tunable sub-portions have a substantially constant cross-section over their lengths 23, the cylindrical diameter 26 of any one of the tunable sub-portions is discretely different from the cylindrical diameter of neighboring tunable sub-portions. Therefore, the tunable sub-portions form a stepped or ridged surface on the shaft 12.

The sub-portions 14(*i*) have wall thickness 24(*i*) (referred to collectively as 24) of the wall 22 that, preferably, vary in linear, inverse relation to the cylindrical diameters 26(*i*) as would be normally substantially accomplished by the swaging of a tube having a substantially constant wall thickness and cylindrical diameter. However, the wall thicknesses 24(*i*) may have other relationships to the cylindrical diameters 26(*i*) without departing from the principles of the invention.

The tunable sub-portions 14(*i*) preferably alternate in the aforedescribed series with corresponding transition portions 160(j) (referred to collectively as 16), where "j" is an integer ranging from 1 to N. Thence, there are at least N−1 transition portions, corresponding to having a tunable sub-portion at each end of the shaft 12. However, preferably, there are N+1 transition portions, so that the shaft 12 has a transition portion 16 at each end thereof Though the tunable sub-portions preferably alternate with the transition portions, neighboring tunable sub-portions that are or would otherwise be adjacent are referred to herein as being adjacent.

Like the tunable sub-portions 14, the transition portions 16 are also hollow as defined by a wall 22 of thickness 240(*j*) (referred to collectively as 240), and have a length 230(*j*) (referred to collectively as 230) which is aligned with the axis "L". However, the transition portions are substantially frustoconical with associated sets of cylindrical diameters 260(*j*) (referred to collectively as 260) that, therefore, continuously increase along the elongate axis "L" from a minor diameter to a major diameter. The wall thicknesses 240(*j*) preferably vary with the cylindrical diameters 260(*j*) in substantially the same linear, inverse relationship as for the tunable sub-portions 14(*i*).

The transition portions 16 are also preferably formed of a metal having an inherently high stiffness, i.e., Young's Modulus, in relation to its weight or density, such as aluminum or, most preferably, titanium.

A transition portion 16 preferably connects each pair of adjacent sub-portions 14. Preferably as well, a first end transition portion 16(1) connects between the handle portion 20 and a first tunable sub-portion 14(1) and a second end transition portion 16(N+1) connects between the barrel portion 18 and a tunable sub-portion 14(N).

The transition portions 16 connect smoothly to their adjacent structures so that, at respective connections 17 therebetween, the cylindrical diameter and wall thickness of the transition portions 16 substantially equals the cylindrical diameter and wall thickness of the tunable sub-portions 14 or the portions 18 and 20 to which the transition portions 16 connect. Thence, the transition portions preferably provide that the cylindrical diameters and the wall thicknesses change continuously with progress along the axis "L".

Figure 3A:
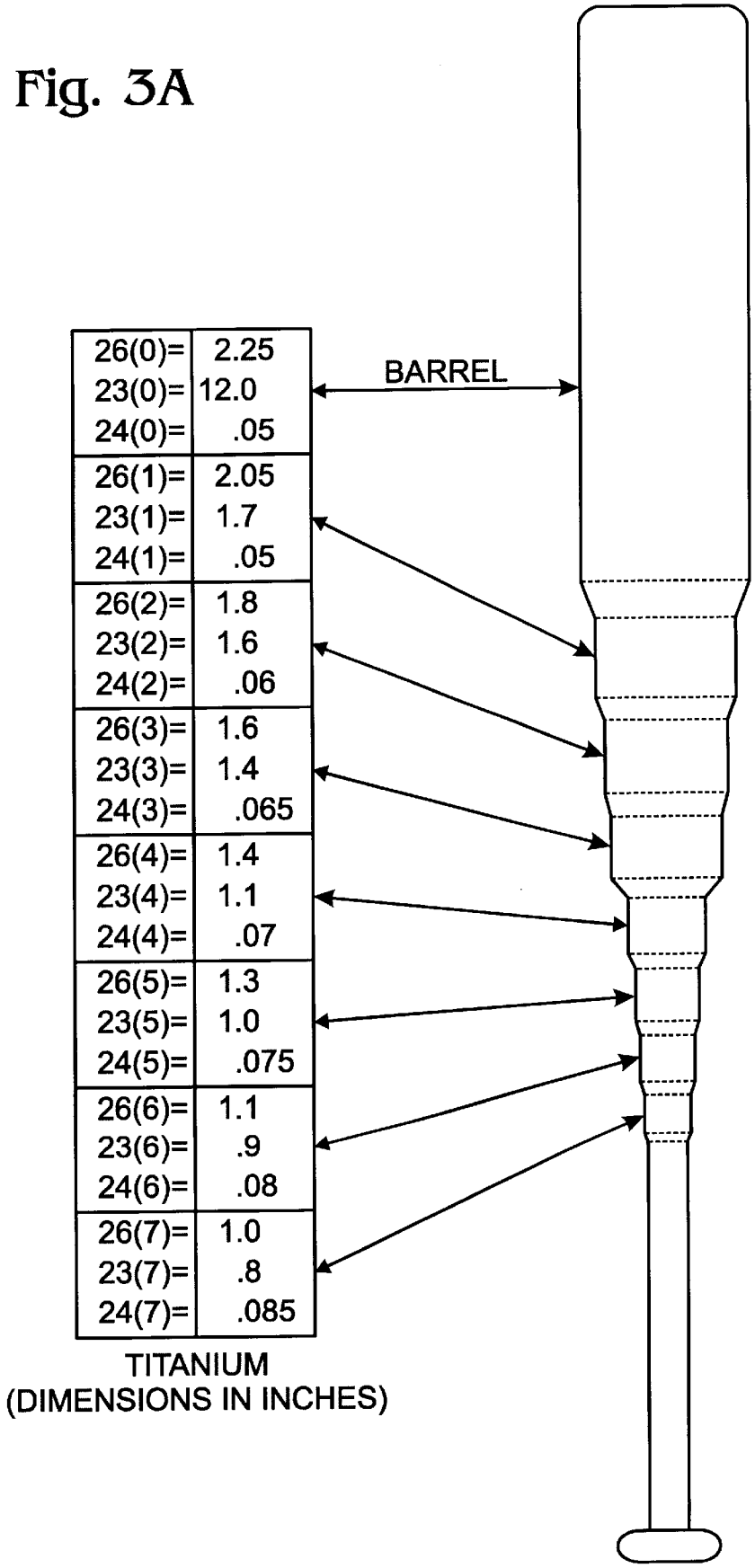
FIG. 3A is a table of a preferred set of parameters for a titanium embodiment of the baseball bat of FIG. 1.
Figure 3B:
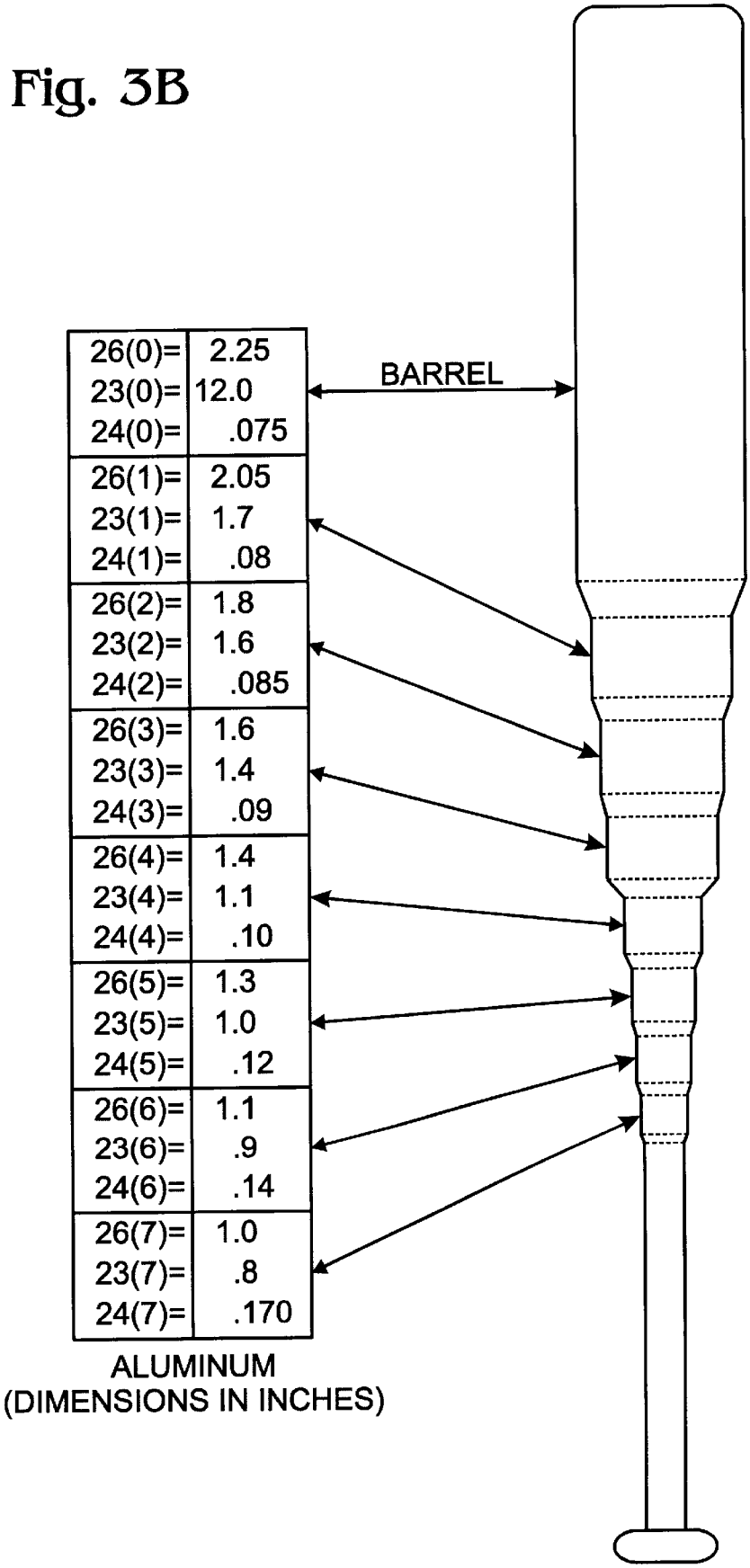
FIG. 3B is a table of a preferred set of parameters for an aluminum embodiment of the baseball bat of FIG. 1.

FIG. 3A shows detailed parameters of a baseball bat 10 having a tunable shaft 12, the baseball bat being constructed of titanium and having been observed to provide superior ball-hitting performance to other baseball bats known in the art. The parameters given indicate the lengths 23, the cylindrical diameters 26, and the wall thicknesses 24, of the tunable sub-portions 14, while the parameters of the transition portions 28 follow therefrom according to the foregoing description. FIG. 3B shows the same parameters for a bat constructed of aluminum.

The above described structure has been to provide a significantly superior ball-hitting performance to that of classically tapered hollow metal bats. It is not known why this is so; however, it is believed that this is due to advantageous vibrational or ringing characteristics of the tuning sub-portions 14 as compared to the vibrational characteristics of the classically tapered bat. Further, it is believed that these vibrational characteristics may be comparatively easily tuned by varying the aforementioned parameters.

More particularly, it is believed that the tunable sub-portions 14 provide for distinct and spaced vibrational modes ("tones"), such as bending and trampoline modes. The tunable sub-portions have constant cylindrical diameters 26(*i*) and constant wall thickness 24(*i*) over a significant length 23(*i*). It is believed that the constancy of these parameters over a significant length of a tunable sub-portion provides for tones that are relatively strong and distinct from the tones of other tunable sub-portions. The large, discrete, and differently sized tunable sub-portions 14 are believed to provide discrete and distinct tones of large amplitude rather than a continuum of tones of vanishingly small amplitude as would be expected in a classically tapered bat. This is believed to have an advantageous physical effect as well as providing for a potentially a comparatively simpler analysis of the frequency modes of the bat 10.

It is also believed to be important that the cylindrical diameters 26 of the tunable sub-portions 14 generally, though not necessarily always, increase with increasing proximity to the ball-hitting end of the sporting implement. The tunable sub-portions 14 together are believed to ring in a Fourier sum of tones that optimizes the dynamic performance of the bat 10. The Fourier sum may be tuned by adjusting the aforementioned parameters, alone or in combination, for one or more tunable sub-portions, taken alone or in combination, or by adjusting the geometry and structure of the sub-portions.

Figure 4:
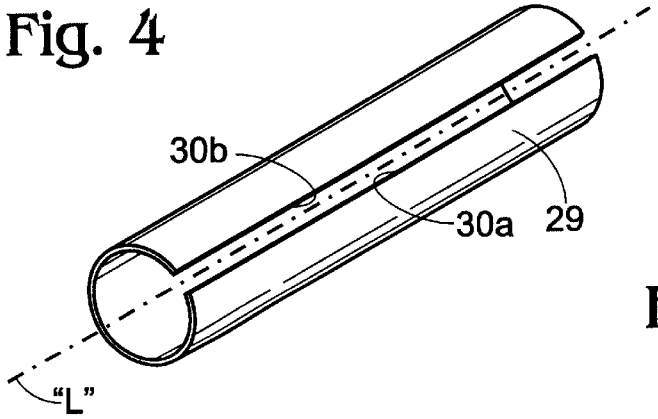
FIG. 4 is a pictorial view of a sheet adapted for forming the baseball bat of FIG. 1 according to the present invention.

Turning now to a method for forming the bat 10, the tunable shaft 12 is preferably formed of a tubular stock of the desired metal, preferably titanium. The tubular stock is selected so as to have an external diameter of appropriate size for receiving the barrel portion 18 as aforedescribed. Referring to FIG. 4, alternatively, sheet stock 29 may be rolled into a tubular form and opposite edges 30*a*, 30*b* of the sheet joined as by being butt-welded. The edges thence form a seam that runs substantially parallel to the elongate axis "L".

It has been found that the aforedescribed stepped structure of the shaft 12 is advantageously provided by the method of swaging. In swaging as employed in the present invention, portions of the shaft 12 are cold squeezed and remaining portions of the shaft 12 are permitted to cold flow in response thereto. Accordingly, a limited length of the shaft 12 may be swaged at one time. The swaging decreases the diameter of the shaft 12 to a desired diameter 26(*i*) and, consequently, increases the wall thickness 24(*i*) substantially proportionately. To a limited extent, swaging also increases the length of the shaft 12, and this should be taken into account in planning the fabrication thereof.

Swaging as employed in the present invention employs a pair of half-circumferential swaging dies, the swaging dies being shaped to conform to the external shape of one or more of the desired tunable sub-portions 14 and transition portions 16.

Other methods of forming the shaft 12 will be apparent to those of ordinary skill in the art and may be employed without departing from the principles of the invention. As an example, shaping of the metal of the shaft 12 may be facilitated by hot-working the metal. As another example, the shaft 12 could be formed by pressing out bilaterally symmetric halves and joining the halves, such as by butt-welding.

Figure 5:
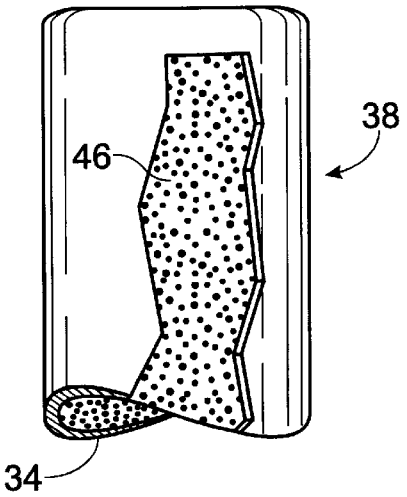
FIG. 5 is a partially cut-away view of a barrel according to the present invention, employing a sound-deadening material, for joining to the baseball bat of FIG. 1, according to the present invention.

Referring back to FIG. 1, the bat 10 includes a barrel 38 and a handle 40, each of which may be machined, formed, molded or cast. The barrel 38 and the handle 40 are attached, respectively, to the barrel portion 18 and the handle portion 20 of the shaft 12. Preferably, the shaft 12, the barrel 38 and the handle 40 are formed of the same alloy of metal to facilitate their being joined by welding. Preferably as well, the barrel 38 is deep drawn to form a cupped shape for joining to the shaft 12. Preferably, the barrel 38 is joined to the barrel portion 18 of the shaft by joining an exposed circumference 34 of the barrel to a distal most circumferential edge 36 of the shaft, as shown in FIGS. 1 and 5. Alternatively, the barrel and handle may be slightly undersized with respect to the shaft 12, or may include slightly undersized extension portions, for press-fitting into the barrel portion 18 of the shaft.

Referring to FIG. 5, preferably, a sound absorbent material 46, such as foam rubber, is inserted into the barrel portion 18 of the shaft 12 prior to attachment of the barrel 38, for deadening the ringing of the hollow metal bat 10, to more closely approximate the sound of a wood bat. The density of the sound deadening material may be desirably increased, such as when foam rubber is employed as the sound deadening material, by compressing the material into the barrel 38.

It is to be recognized that, while a specific embodiment of a baseball bat having a tunable shaft and a method for construction thereof have been described as preferred, other configurations and methods could be utilized without departing from the principles of the invention. In particular, because it is not known why the aforedescribed structure provides for significant performance increase, it will be appreciated that the invention is not limited to the specific embodiment disclosed, as alternative embodiments within the concept of the invention are anticipated to become evident and, potentially, numerous. For example, in the preferred embodiment, there are a limited number of tunable sub-portions, such as the 7 shown in FIGS. 3A and 3B. It is expected that more or fewer tunable sub-portions will provide for advantage. As another example, it is anticipated that a tunable sub-portion may have a cylindrical diameter and wall thickness that varies in a different manner than that described above. For example, a tunable sub-portion may advantageously be provided as having a larger cylindrical diameter than adjacent tunable sub-portions on either side. As still a further example, the shape and structure of the transition portions may bear on the observed performance and may vary from that described.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. A baseball bat, comprising:

a barrel portion adapted for hitting a baseball;

a handle portion adapted for holding the baseball bat; and an elongate, tunable shaft comprising a plurality of tunable sub-portions, said shaft connecting between said barrel portion and said handle portion, said tunable sub-portions having associated diameters that vary from the diameters of adjacent of said tunable sub-portions by discrete amounts, wherein said diameters generally increase with increasing proximity to said barrel portion, wherein said tunable sub portions are disposed in a series, the baseball bat further comprising one or more hollow, frustoconical transition portions connected between adjacent of said tunable sub-portions, a major diameter of said transition portions substantially equaling the diameter of said respective cylinder of one of said adjacent tunable sub-portions and a minor diameter of said transition portions substantially equaling the diameter of said respective cylinder of said other adjacent tunable sub-portion, wherein said transition portions have substantially continuously varying diameters between said major diameter and said minor diameter and associated wall thickness that vary in substantially linear, inverse relation to said associated diameters.

2. The baseball bat of claim 1, wherein the diameters and wall thickness of said transition portions substantially equal, respectively, the diameters and wall thickness of adjacent of said tunable sub-portions at respective connections therebetween.

3. The baseball bat of claim 1, wherein the wall thickness of each of said transition portions decreases in substantially linear relationship with the proximity of the associated diameter of said transition portion to said barrel portion.

* * * * *